US005107871A

United States Patent [19]

Butcher et al.

[11] Patent Number: 5,107,871

[45] Date of Patent: Apr. 28, 1992

[54] COMPACT CONTAINER

[75] Inventors: John D. Butcher, Morristown, N.J.; JoAnne L. Gindek, New York, N.Y.

[73] Assignee: Revlon, Inc., New York, N.Y.

[21] Appl. No.: 744,045

[22] Filed: Sep. 3, 1991

Related U.S. Application Data

[63] Continuation of Ser. No. 546,152, Jun. 28, 1990.

[51] Int. Cl.[5] ..... A45D 42/02

[52] U.S. Cl. ..... 132/304; 132/293; 132/301; 132/296; 206/581; 206/823

[58] Field of Search ..... 132/286, 293, 295, 296, 132/301, 304, 314, 315, 316, 317; 206/581, 823

[56] References Cited

U.S. PATENT DOCUMENTS

| | | | |
|---|---|---|---|
| D. 280,450 | 4/1985 | Schefer | D28/78 |
| 1,383,394 | 7/1921 | Fisher | 132/307 |
| 1,460,906 | 7/1923 | Hyde | 132/296 |
| 1,525,665 | 2/1925 | Slover et al. | 132/296 |
| 1,537,591 | 5/1925 | Dodson | 132/299 |
| 1,553,049 | 9/1925 | Romero | 132/307 |
| 1,570,382 | 1/1926 | Lyhne | 132/296 |
| 1,583,120 | 5/1926 | Brenner | 132/296 |
| 1,613,798 | 1/1927 | Kendall | 132/293 |
| 1,622,463 | 3/1927 | Marcus | 132/304 |
| 1,647,004 | 10/1927 | Hyde | 132/296 |
| 1,650,733 | 11/1927 | Wilson | 132/294 |
| 1,735,483 | 11/1929 | Wacker | 132/296 |
| 1,736,724 | 11/1929 | Setvate | 132/296 |
| 1,804,943 | 5/1931 | Maillard | 132/299 |
| 1,838,697 | 12/1931 | McAfree | 132/294 |
| 1,912,187 | 5/1933 | Fullmer | 132/301 |
| 2,031,933 | 2/1936 | Clegg | 132/287 |
| 2,054,004 | 9/1936 | Sandberg | 132/293 |
| 2,056,935 | 10/1936 | Esterow et al. | 132/301 |
| 2,196,017 | 4/1940 | Kane | 132/296 |
| 2,204,717 | 6/1940 | Younghusband | 132/292 |
| 2,260,764 | 10/1941 | Anderson | 132/301 |
| 2,570,314 | 10/1951 | Brand | 132/304 |
| 2,628,625 | 2/1953 | Pike | 132/315 |
| 3,342,190 | 9/1967 | Hultgren | 132/301 |
| 4,369,799 | 1/1983 | Napolean | 132/294 |
| 4,696,317 | 9/1987 | Shioi et al. | 132/314 |
| 4,834,122 | 5/1989 | Yuhara | 132/301 |

FOREIGN PATENT DOCUMENTS

| | | | |
|---|---|---|---|
| 252025 | 9/1948 | Switzerland | 132/293 |
| 376875 | 7/1932 | United Kingdom . | |
| 0764125 | 12/1956 | United Kingdom . | |
| 866357 | 4/1961 | United Kingdom . | |

OTHER PUBLICATIONS

Cosmetic World, 4/23/1990, vol. XXVI, No. 1, pp. 181, 182.

*Primary Examiner*—John J. Wilson
*Assistant Examiner*—Frank A. LaViola
*Attorney, Agent, or Firm*—Julie Blackburn

[57] ABSTRACT

A compact container comprising a tray containing cosmetic and covered by a fine mesh screen, a mirror, and a separate compartment suitable for storing a cosmetic applicator to be used to apply the cosmetic.

4 Claims, 2 Drawing Sheets

COMPACT CONTAINER

This is a continuation of Ser. No. 546,152 filed on Jun. 28, 1990, pending.

TECHNICAL FIELD

The invention is directed to a cosmetic compact comprising a containing cosmetic covered by a fine mesh screen, a mirror, and a separate compartment suitable for containing a cosmetic applicator.

BACKGROUND OF THE INVENTION

Compact containers for holding and storing powder, rouge, or other cosmetics are well known in the art. Generally these compacts contain a base compartment which holds the cosmetic and a cover compartment hinged to the base which provides for movement of the cover between an open and closed position. It is also well known in the art to use fine mesh screens to cover the cosmetic in the compact. Particularly if the cosmetic is face powder, such screens allow for an even application of Powder to the powder puff and prevent spillage or blowing of the powder. In these compacts the applicator used width the cosmetic is either stored separately or just above the fine mesh screen within the compact. However, storing the applicator on top of the mesh screen is undesirable, Particularly if the cosmetic is a liquid, oil, or paste. The cosmetic material tends to impregnate the applicator resulting in waste and the applicator becomes very messy to use making it more likely for cosmetic to get on hands, clothes, and throughout the compact itself. There is need for a compact which holds cosmetic covered by a fine mesh screen and which contains a separate compartment for storing the cosmetic applicator.

SUMMARY OF THE INVENTION

The invention is directed to a compact comprising a bottom compartment containing a tray means for containing cosmetics, a fine mesh screen covering said tray means and a top compartment containing a cavity suitable for storage of an applicator for said cosmetic, and between said bottom and top compartments a divider section hinged to said bottom compartment which divider section has a mirror on its bottom side facing the tray means and wherein the top side of said divider section serves as a platform suitable for resting an applicator to be used with said cosmetic.

DETAILED DESCRIPTION

Figure 1:
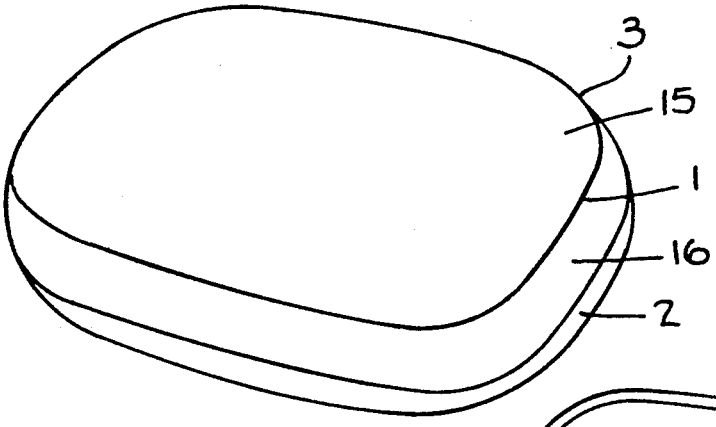
FIG. 1: is a front perspective view of the closed compact.

Referring to the drawings in detail the compact or container 1 according to the Present invention comprises a bottom compartment 2, a top compartment 3 and a divider section 4. A hinge assembly 5 pivotally connects the top compartment 3 to the bottom compartment 2 and the divider section 4 is connected to the bottom compartment. The bottom compartment 2 and top compartment 3 move between an open and closed position and permit the divider section 4 to be flipped up or down when the compact 1 is in the open position.

As shown in FIGS. 3-6 the bottom compartment 2 includes a bottom wall 6 a peripheral circumferential rim 19, a peripheral circumferential recess 21, and an inner peripheral wall 7 circumferentially disposed and integrally formed about bottom wall 6 so as to define a chamber or receptacle into which is affixed a cosmetic containing tray means 8. The cosmetic tray means 8 is formed with a side wall 9 and a bottom wall 11 which is integral with said side wall 9 which is of similar circumferential configuration to downwardly extending sidewall 7 and which cosmetic tray is affixed into the chamber 10 of the base compartment. A fine mesh screen 13 of the same circumferential configuration as side wall 9 rests atop cosmetic tray means 8. A frame 14 of the same circumferential configuration as the mesh screen 13 and sidewall 9 sits on top and is attached to the fine mesh screen 13. The frame 14 snugly engages the sides of interior walls 7 of the bottom compartment 2. The cosmetic tray means 8 is held affixed into the chamber 10 of base compartment due to the peripheral circumferential recess 21 which has a inner circumference which slightly extends over the downwardly extending sidewall 7.

The top compartment 3 of the compact has a substantially identical configuration to the bottom compartment 2 and has a top wall 15 and a peripheral wall 16 circumferentially disposed and integrally formed about top wall 15 to define a cavity **16*a* which is suitable for holding an applicator 17 for the cosmetic. Bottom compartment 2 and top compartment 3 are molded as integral units from suitable materials such as plastics. The compact is held closed by a catch comprising a tongue 18 which projects downwardly from the inside central front wall of the top compartment 3. In the central outer portion peripheral rim 19 of the bottom compartment 2 is a slot 20 which is complementary to and adapted to receive said tongue 18** in snapping relation.

Figure 2:
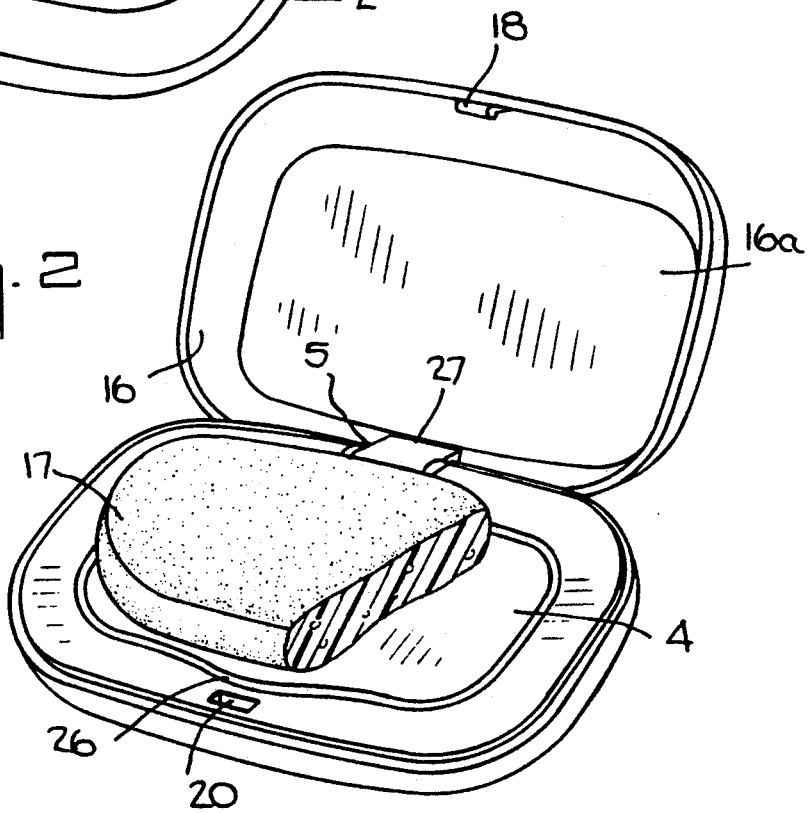
FIG. 2: is a front perspective view of the opened compact with the divider section flipped down to reveal a cross-sectional view of the cosmetic applicator and the divider section platform.
Figure 6:
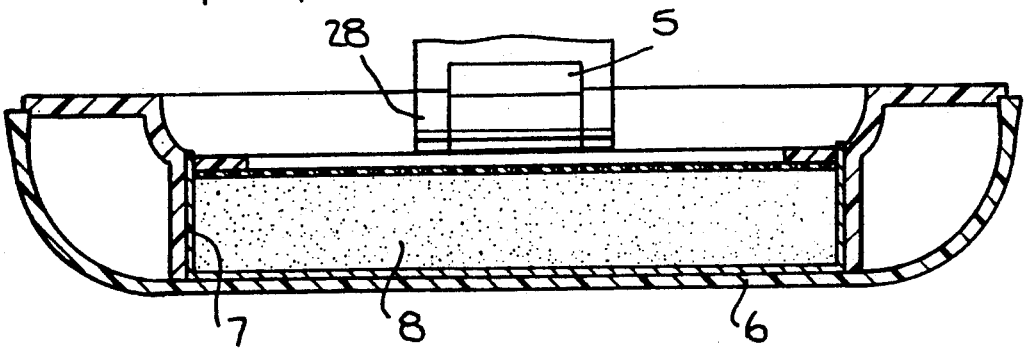
FIG. 6: is a sectional view of the bottom compartment of the compact taken across 6—6 of FIG. 3.
Figure 3:
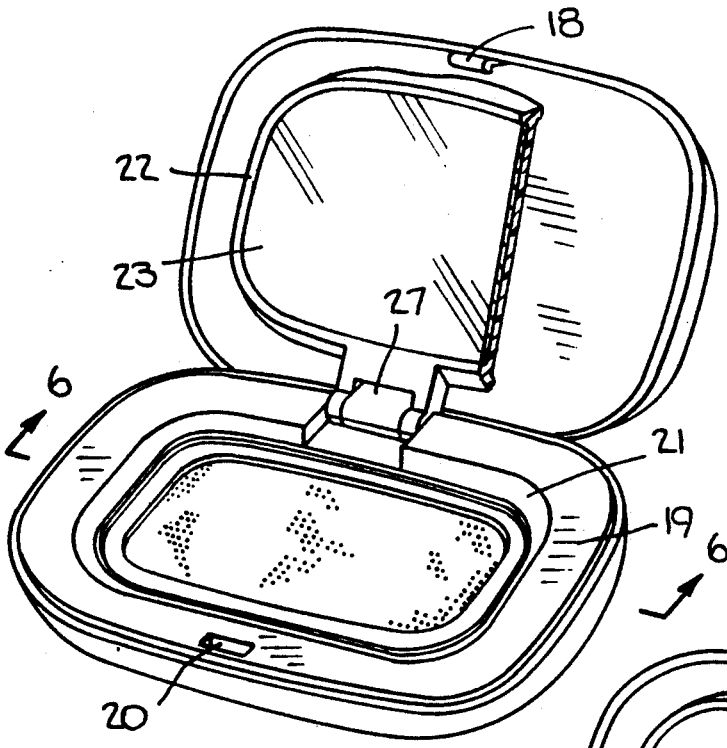
FIG. 3: is a front perspective view of the opened compact. A cross-sectional view of the divider section is shown in the "up" position to reveal the cosmetic tray and mirror as well as the cavity in the top compartment.
Figure 4:
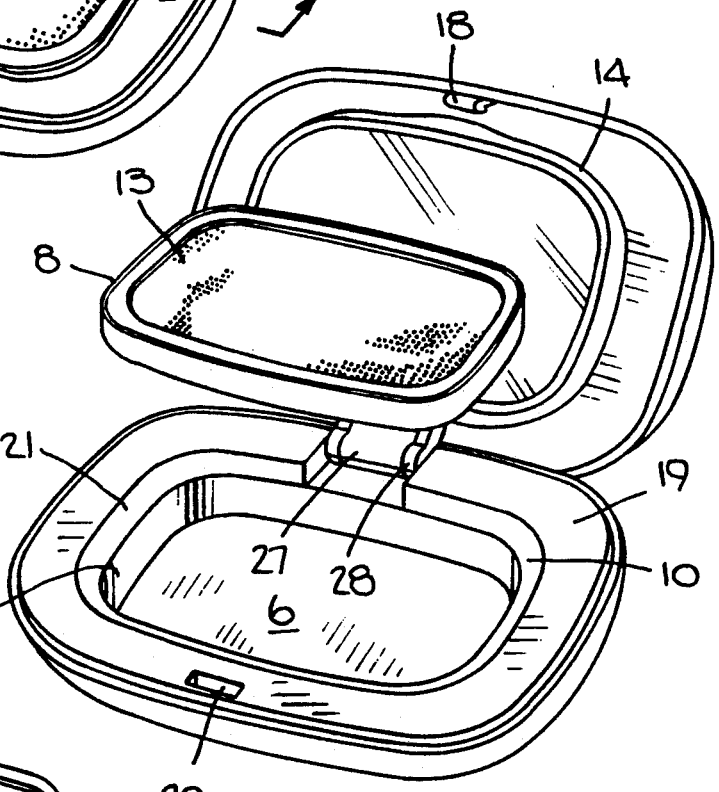
FIG. 4: is an exploded front perspective view of the compact showing how the tray means of cosmetic is affixed into the bottom compartment.
Figure 5:
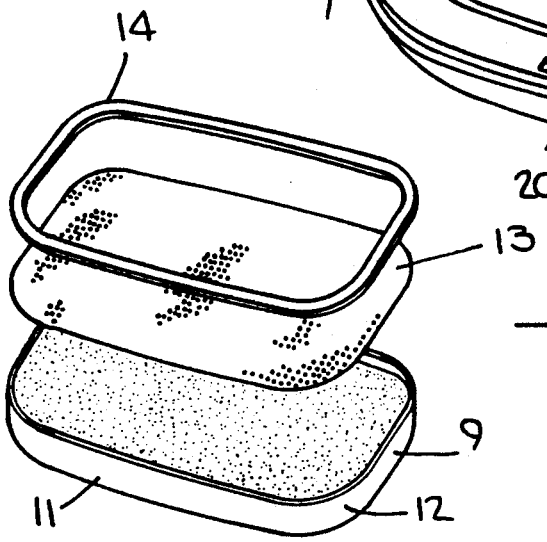
FIG. 5: is a front view showing the assembly of the cosmetic tray means covered by the fine mesh screen.

The divider section 4 consists of an essentially flat planar surface with an attached peripheral lip which edges curves slightly upward to result in a dish-like configuration. The flat planar surface of the divider section has circumferential configuration similar to that of the peripheral circumferential recess 21 into which it fits. The bottom circumferential peripheral surface 22 of the divider section 4 fits removably into the circumferential recess 21. When the divider section is in the upward position as in FIG. 3 the cosmetic tray means 8 is exposed. On the bottom side of the divider section 4 is a mirror 23. When the divider section 4 is in the downward position as in FIG. 2 the top surface of the divider section 4 serves as a platform upon which a cosmetic applicator 17 used to apply said cosmetic is placed. The cosmetic applicator 17 rests on said Platform 4 and fits into the recessed cavity **16*a* of the top compartment. To assist in the divider section 4 being more easily flipped upward, at the outer circumferential edge 25 of the divider section 4 the peripheral circumferential edge is extended to a slightly greater degree to yield a slight Projection 26** which can be dripped by the fingers.

As stated previously the hinge assembly 5 pivotally connects the top compartment 3 to the bottom compartment 2 and the divider section 4 is attached to the bottom compartment. The hinge assembly 5 consists of a tongue 27 which extends from the middle of the back inside circumferential periphery of the top compartment 1. This tongue 27 is bored laterally through its distal end to allow a cylindrical means to fit through said bore. The divider section 4 has at the side opposite the projection 26 two projections 28 which are spaced apart a distance sufficient to allow said tongue 27 to fit between them. These Projections 28 are bored laterally also so that a cylindrical means will thread through the bores of the projections and the tongue to hold the tongue 27 in place between the projections 28 and to secure them to the bottom compartment.

The screen covered cosmetic tray is suitable for use with powders, rouges, but particularly with heavy liquid, oil or paste-type compositions such as foundation make-ups, rouge, concealer, eyecolor, etc. The fine mesh screen enables controlled application of cosmetic to the applicator thus protecting against waste. The mesh screen is of such a consistency that it may be easily depressed with pressure thus following the decreasing levels of cosmetic in the tray as it is used up. The separate storage compartment provided for the cosmetic applicator keeps the applicator from resting on the fine mesh screen. The applicator thus remains cleaner and is less likely to soil hands and clothes. The mirror facilitates cosmetic application by the user when a powder room is not convenient. The specific placement of the mirror on the opposite side of the divider from the applicator enables it to remain unsoiled.

While the invention has been described in connection with the preferred embodiment it is not intended to limit the scope of the invention to the particular form set forth but, on the contrary, it is intended to cover such alternatives, modifications, and equivalents as may be included within the spirit and scope of the intended claims.

We claim:

1. A compact comprising a bottom compartment containing a tray means for containing cosmetic, said bottom compartment comprising a peripheral circumferential rim, a peripheral circumferential recess and an inner peripheral wall circumferentially disposed and integrally formed about said bottom wall so as to define a chamber into which is affixed said cosmetic tray means, a fine mesh screen covering said tray means, a frame of the same circumferential configuration as the mesh screen which sits on top and is attached to said fine mesh screen, a top compartment hinged to said bottom compartment and between said bottom and top compartments a divider section comprising an essentially flat planar surface with an attached peripheral lip having edges which curve slightly upward to form a dish-like configuration with a top side and a bottom side hinged to said bottom compartment at the place where the top compartment has a mirror on its bottom side facing the tray means and wherein the top side of said divider section serves as a platform suitable for resting an applicator to be used with said cosmetic.

2. The compact of claim 1 wherein said cosmetic tray containing a composition selected from the group consisting of heavy liquid, oil, and paste.

3. The compact of claim 2 containing a sponge applicator for said cosmetic.

4. The compact of claim 3 wherein the cosmetic tray contains a composition selected from the group consisting of foundation make-up, blush, eyecolor, and concealer.

* * * * *